United States Patent [19]

Robak, Sr. et al.

[11] Patent Number: 4,883,942

[45] Date of Patent: Nov. 28, 1989

[54] LOW VOLTAGE HEATING ELEMENT FOR PORTABLE TOOLS

[75] Inventors: Frank E. Robak, Sr.; Andrew H. Robak, Jr., both of Omaha, Nebr.

[73] Assignee: RobaTherm Products, Omaha, Nebr.

[21] Appl. No.: 170,921

[22] Filed: Mar. 21, 1988

[51] Int. Cl.[4] ..... H05B 3/06

[52] U.S. Cl. ..... 219/227; 219/229; 219/236; 219/354

[58] Field of Search ..... 219/227, 346, 221, 225, 219/229, 236, 85 BA, 85 BM, 354, 352, 353, 523; 313/315, 316

[56] References Cited

U.S. PATENT DOCUMENTS

| | | | |
|---|---|---|---|
| 289,590 | 12/1883 | White | 362/380 |
| 439,238 | 10/1890 | Faught | 433/32 |
| 697,825 | 4/1902 | Fisk | 219/473 |
| 771,424 | 10/1904 | Fisk | 219/524 |
| 793,158 | 6/1905 | Rolfe | 219/242 |
| 793,229 | 6/1905 | Rolfe | 219/552 |
| 819,793 | 5/1906 | Phelps | 313/316 |
| 849,368 | 4/1907 | Christian | 219/313 |
| 977,361 | 11/1910 | Baker et al. | 219/353 |
| 1,004,956 | 10/1911 | Alden | 219/520 |
| 1,013,327 | 1/1912 | Smith | 219/473 |
| 1,050,967 | 1/1913 | McComb | 362/255 |
| 1,284,792 | 11/1918 | Schwartz | 132/232 |
| 1,319,728 | 10/1919 | Smits | 219/552 |
| 1,723,743 | 8/1929 | Mason | 219/523 |
| 1,770,642 | 7/1930 | Gelino | 219/205 |
| 1,796,761 | 3/1931 | O'Brien | 219/523 |
| 1,993,781 | 3/1935 | Hampton et al. | 219/239 |
| 2,013,095 | 9/1935 | Friend | 250/27.5 |
| 2,045,903 | 6/1936 | Fortin | 219/275 |
| 2,124,543 | 7/1938 | Clyne | 219/274 |
| 2,182,904 | 12/1939 | Rorer | 176/34 |
| 2,307,027 | 1/1943 | Davie et al. | 250/27.5 |
| 2,364,730 | 12/1944 | Leskin | 219/227 |
| 2,507,736 | 5/1950 | Ritchie et al. | 315/83 |
| 2,604,571 | 7/1952 | Naulty et al. | 219/230 |
| 2,611,853 | 9/1952 | Kerby | 219/209 |
| 2,751,485 | 6/1956 | Sauer | 228/53 |
| 2,902,577 | 9/1959 | Brown | 228/18 |

(List continued on next page.)

FOREIGN PATENT DOCUMENTS

| | | | |
|---|---|---|---|
| 105756 | 7/1898 | Fed. Rep. of Germany | 219/227 |
| 2819725 | 11/1979 | Fed. Rep. of Germany | 219/346 |
| 756541 | 12/1933 | France | 219/354 |
| 1522777 | 8/1978 | United Kingdom | 219/346 |

OTHER PUBLICATIONS

Leedy, R. M., "Control of Radiant Heat by Surface Finish", Westinghouse Engineer, Jul. 1954, pp. 147–151.

*Primary Examiner*—Teresa J. Walberg

*Attorney, Agent, or Firm*—Oblon, Spivak, McClelland, Maier & Neustadt

[57] ABSTRACT

A low voltage heating element for portable tools includes a low voltage, low current light bulb wrapped with a thin layer of metal darkened on its bulb-facing surface. Apertures in the metal layer allow the light from the bulb to be utilized in addition to its heating characteristics. Rechargeable batteries are installed in the handle of the tool to power the light bulb. An electrical jack in the tool housing may be plugged into an external power source for providing power for a greater length of time. A cordless soldering iron includes a low voltage, low current light bulb affixed to the tip of a conventional soldering iron, the conventional heating element having been removed from the housing. The bulb is wrapped with a layer of metal darkened on the bulb-facing surface, and is electrically connected to rechargeable batteries mounted either in the housing of the soldering iron, or within an external pack. A cordless curling iron includes a low voltage, low current light bulb removably mounted within the housing of the curling iron, the conventional heating element having been removed therefrom. The portable tools, soldering iron, hot glue gun and curling iron, are provided with an electrical jack for selectively receiving electric power from a power pack to recharge the batteries therein and to selectively supply power to the low voltage light bulb. The power pack is electrically connected to a conventional 110 V. a.c. power source and transforms this to low voltage, low current D.C. electricity.

23 Claims, 3 Drawing Sheets

U.S. PATENT DOCUMENTS

| | | | |
|---|---|---|---|
| 3,005,084 | 10/1961 | Eagan | 219/415 |
| 3,023,295 | 2/1962 | Johnson | 219/26 |
| 3,151,233 | 9/1964 | Noel | 219/220 |
| 3,209,188 | 9/1965 | Freeman | 313/43 |
| 3,235,706 | 2/1966 | Neumann et al. | 219/227 |
| 3,437,252 | 4/1969 | Beaver et al. | 228/53 |
| 3,485,417 | 12/1969 | Cocks | 222/146 |
| 3,612,357 | 10/1971 | Ruskin | 222/146 |
| 3,707,258 | 12/1972 | Schliff | 228/52 |
| 3,743,142 | 7/1973 | Elliott et al. | 222/146 |
| 3,744,921 | 7/1973 | Weller et al. | 401/2 |
| 3,792,228 | 12/1974 | Wei-Cheng | 219/230 |
| 3,814,973 | 6/1974 | Thouret et al. | 313/313 |
| 3,864,547 | 2/1975 | Ray | 219/85 BA |
| 3,934,597 | 1/1976 | McNair | 132/37 |
| 4,029,935 | 6/1977 | Archer et al. | 219/228 |
| 4,082,940 | 4/1978 | Knowles et al. | 219/239 |
| 4,097,718 | 6/1978 | Weise | 219/222 |
| 4,101,757 | 7/1978 | Van Dyck | 219/506 |
| 4,199,082 | 4/1980 | Ornsteen | 222/146 |
| 4,233,493 | 11/1980 | Nath | 219/85 BA |
| 4,320,857 | 3/1982 | Herb et al. | 222/146 |
| 4,375,589 | 3/1983 | Combs | 219/315 |
| 4,493,972 | 1/1985 | Steinel et al. | 219/230 |
| 4,523,705 | 6/1985 | Belanger et al. | 226/127 |
| 4,539,987 | 9/1985 | Nath | 219/85 BA |
| 4,549,560 | 10/1985 | Andis | 132/37 |
| 4,600,857 | 7/1986 | Suhar | 313/35 |
| 4,602,143 | 7/1986 | Mack | 219/225 |
| 4,647,755 | 3/1987 | Mack | 219/222 |
| 4,692,586 | 9/1987 | Fromm et al. | 219/225 |

LOW VOLTAGE HEATING ELEMENT FOR PORTABLE TOOLS

TECHNICAL FIELD

This invention relates generally to heating elements for "cordless" or portable tools, and more particularly to heating elements which utilize rechargeable batteries as their power source.

BACKGROUND OF THE INVENTION

Electrical heating elements have long been known in the prior art, as is well documented by the vast number of patents referred to in the attached Prior Art Statement. These heating elements have been utilized in a number of tools, such as soldering irons, curling irons and more recently hot melt glue guns. While these tools have been utilized in the field for many years, they all have one major problem in common —namely, they must be electrically connected to a conventional 110 volt power source. This makes their portability quite limited, since an extension cord is always required.

These tools share a number of other problems which also relate to the lack of portability in the devices. Known tools which utilize electrical heating elements require very high temperatures in order to operate. These high temperatures are produced using electrical resistance in coil wrapped around a heavy, solid core, the core retaining the heat for long periods of time. However, besides being heavy, the conventional heating element requires a large voltage or current for an extended period of time in order to heat the core to the desired temperature. For this reason, it was heretofore unknown and believed infeasible to utilize conventional flashlight-type batteries to supply the power to the tool.

While "cordless" operation has been recently introduced in the field for drills, screwdrivers, flashlights and small vacuums, such devices utilize a high current power source. For this reason it was not possible to operate a tool merely by plugging the tool via its "power pack" into a conventional A.C. power source. The power pack supplies only a small current to the rechargeable batteries to recharge them. The low current is unable to actually operate the tool. In the same manner, use of an adaptor or converter which plugs into the cigarette lighter of a car to access the 12 volt battery source of the car would likewise not be able to supply the needed current to operate the tool.

Another problem with conventional tools which have electrical heating elements is in the amount of time required to heat the element to the required temperature, and the amount of time required for the heated element to cool off after use. Because of the heavy weight and large mass of the cores on conventional heating elements, it can be seen that the amount of time and power required to heat the heat element core was substantial. These large mass cores were required, however, in order to maintain the extremely high temperatures of 250°–400° F necessary for melting solder, thermal plastic, etc. —as used in soldering irons, and hot melt glue guns.

Yet another problem with the conventional tools utilizing electrical heating elements is in the fact that it is difficult to illuminate the work area during operation of the tool. While hot glue guns and soldering irons in the prior art disclose that light bulbs have been used in an attempt to illuminate the work area, the location of the light bulb made it difficult to adequately illuminate the desired area.

Still a further problem with prior art curling irons, soldering irons and hot glue guns is in the difficulty in replacing the electrical heat elements in these tools. Not only is the heating element typically permanently attached, but is very complicated and expensive to replace.

All of these devices are also a potential electrical hazard because of the use of 110 volt household current. Use of a curling iron in a bathroom and near water is especially dangerous, but is a common problem.

SUMMARY OF THE INVENTION

It is therefore a general object of the present invention to provide an improved low voltage, low current heating element.

Another object of the present invention is to provide a low voltage, low current heating element capable of producing extremely high temperatures.

Another object is to provide a heating element which reaches its maximum temperature in a short amount of time.

Another object of the present invention is to provide a heating element which would maintain a high temperature for long periods of time yet be light weight.

Another object of the present invention is to provide a heating element which also provides light directly at the work area.

Yet another object is to provide a heating element which is operable with either A.C. or D.C. electric current.

Another object of the present invention is to provide a heating element which is easily and inexpensively replaced.

These and other objects of the present invention will be apparent to those skilled in the art.

The low voltage heating element for portable tools of this invention includes a low voltage, low current light bulb which is wrapped with a thin layer of metal darkened on its bulb-facing surface. Apertures in the metal layer allow the light from the bulb to be utilized in addition to its heating characteristics. A 12-volt halogen light bulb wrapped with a darkened thin copper jacket is preferred to produce the greatest heat in the shortest amount of time. Rechargeable batteries are installed in the handle of the tool to power the light bulb. An electrical jack in the tool housing may be plugged into an external power source for providing power for a greater length of time.

The cordless soldering iron of this invention includes a low voltage, low current light bulb affixed to the tip of a conventional soldering iron, the conventional heating element having been removed from the housing. The bulb is wrapped with a layer of metal darkened on the bulb-facing surface, and is electrically connected to rechargeable batteries mounted either in the housing of the soldering iron, or within an external pack. The external pack may contain more and larger batteries.

The cordless curling iron of this invention includes a low voltage, low current light bulb removably mounted within the housing of the curling iron, the conventional heating element having been removed therefrom.

The portable tools, soldering iron, hot glue gun and curling iron, are provided with an electrical jack for selectively receiving electric power from a power pack to recharge the batteries therein and to selectively supply power to the low voltage light bulb. The power pack is electrically connected to a conventional 110 V. a.c. power source and transforms this to low voltage, low current D.C. electricity.

DESCRIPTION OF THE PREFERRED EMBODIMENTS

Figure 4:
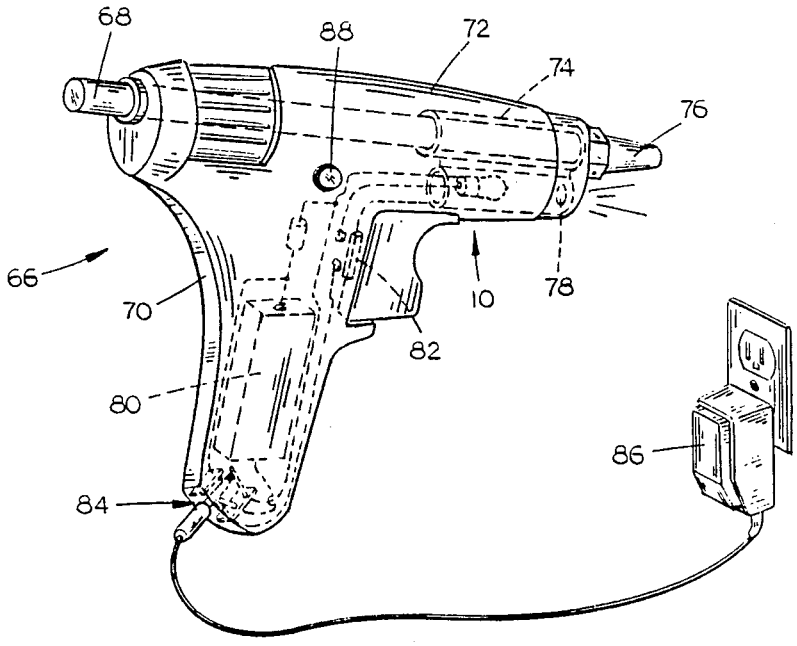
FIG. 4 is a perspective view of a cordless hot glue gun utilizing the present invention.
Figure 1:
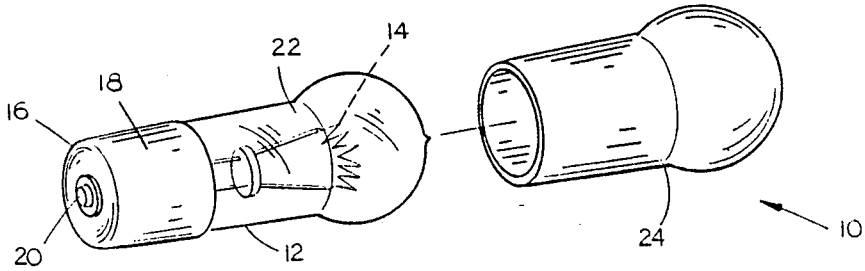
FIG. 1 is an enlarged exploded perspective view of the heating element of this invention.
Figure 2:
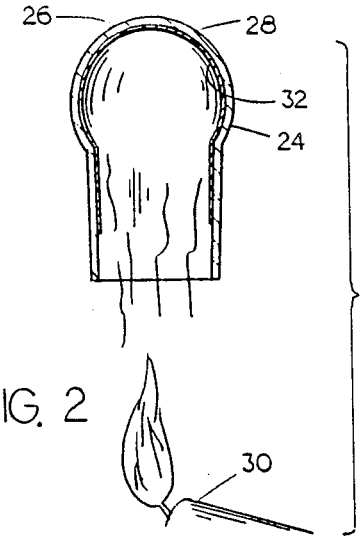
FIG. 2 is a partial sectional view of the bulb jacket showing how the darkening coat is applied.
Figure 3:
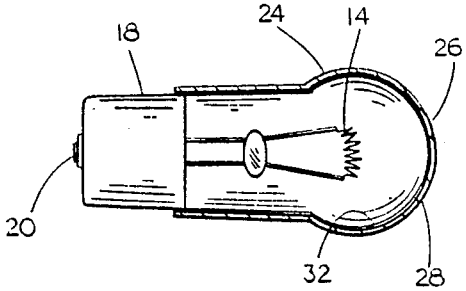
FIG. 3 is a partial sectional view of the heating element.

Referring now to the drawings, in which similar or corresponding parts are identified with the same reference numerals, the heating element of this invention is designated generally at 10 and includes a conventional low voltage light bulb 12 of the type utilized in flashlights, automobile lighting systems and the like.

Light bulb 12 is preferably of the 12-volt (or less) variety and includes a filament 14 which is energized to produce light. However, this small light bulb 12 also produces heat to an extent heretofore not utilized. Light bulb 12 includes a base 16 having a metal cover which provides a negative terminal 18 electrically connected to a socket (not shown), and a positive terminal 20 projecting from the base and electrically separated from metal negative terminal 18.

The inventors have found that extremely high temperatures, varying from 120° F to greater than 400° F, can be produced by wrapping the glass or transparent portion 22 of the bulb 12 with a thin sheet of heat-conductive material 24 such as copper or the like. In order to enhance the uniform dissipation of heat, the metal jacket 24 should be formed with the fewest number of projections such as fins or points as is possible. One or more apertures 26 and 28 may be formed in the metal jacket in order to allow light to project from the bulb immediately on the work area.

While the use of a metal jacket 24 around the bulb increases the temperature which may be achieved with the light bulb 12, the inventors have found that providing a dark-colored coating on the inside surface of the jacket 24 further enhances the high temperatures which may be achieved. The inventors have experimented with a number of paints and other coatings of dark color for use on the metal jacket 24, but have found that most such coatings burn off, produce smoke, or produce fumes, under the high temperatures involved. The inventors discovered that use of a burning candle 30 to apply carbon products 32 produced through combustion may be applied to the metal jacket to darken the jacket and yet eliminate all smoking, burning or fuming of the coating. Furthermore, the carbon based coating which is applied to the metal jacket 24 by candle 30 can be controlled as to its thickness and density for heat absorbing purposes.

Figure 6:
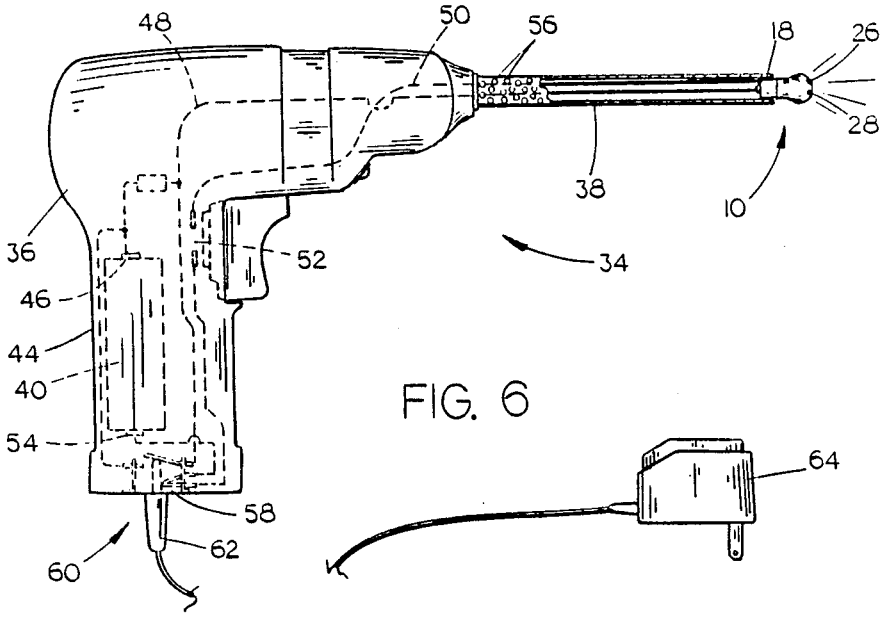
FIG. 6 is an elevational view of a cordless soldering iron utilizing the present invention.

Referring now to FIG. 6, a soldering iron 34 has been adapted to utilize the light bulb heat element 10 of this invention to produce the needed heat. Soldering gun 34 includes a housing 36 in the shape of a gun, with a hollow metal tube 38 projecting from one end. The conventional heating element (not shown) has been removed from the housing 36, thereby eliminating a substantial amount of the weight of the soldering iron. A cartridge 40 containing rechargeable batteries is mounted within the stock portion 44 of housing 36. The positive terminal 46 of the battery cartridge 40 has an electrical conductor 48 connected thereto, the conductor 48 extending through the housing 36 and through hollow metal tube 38 to light bulb 12. Conductor 48 is electrically connected to the positive terminal of light bulb 12. The negative terminal 18 of light bulb 12 is connected, via conductor 50, to one terminal of a normally-open switch 52. The other terminal of normally-open switch 52 is electrically connected to the negative terminal 54 of battery cartridge 40. Thus, when switch 52 is closed D.C. electrical current lights light bulb 12, thereby producing heat in heating element 10.

A plurality of apertures 56 are located in the housing-connected end of hollow metal tube 38 in order to serve as cooling ports. Apertures 56 allow heat to escape from within tube 38 thereby cooling the tube and its connection to housing 36 to prevent melting of the housing.

Apertures 26 and 28 in metal jacket 24 dramatically show the benefit of utilizing a light bulb as the heating element, since the work area is directly illuminated during operation of the soldering iron.

The female portion 58 of an electrical jack 60 is mounted in the base of stock portion 44 of housing 36. Socket 58 is conventional, and includes positive and negative terminals which are electrically connected to battery cartridge 40 and light bulb 12. A male plug 62, adapted to be received within female portion 58 of electrical jack 60, is electrically connected to a power pack 64 which converts conventional 110 volt a.c. current to low voltage (6 to 12 volt) D.C. current. It can therefore be seen that when plug 62 is connected to female portion 58 the rechargeable batteries in cartridge 40 will be charging from current provided from the household.

Figure 7:
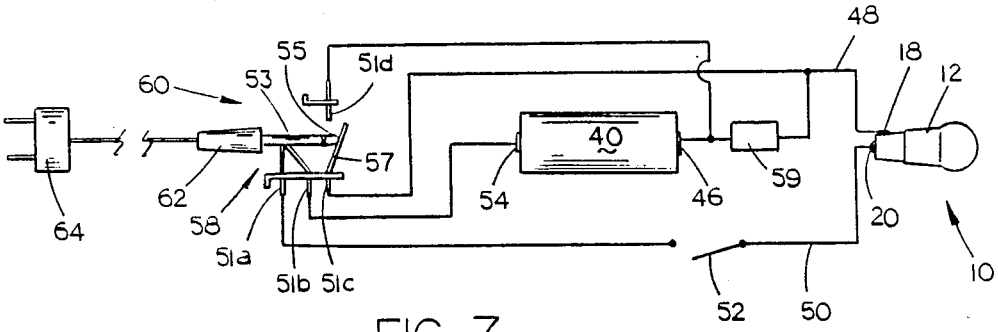
FIG. 7 is a schematic diagram of the electrical wiring for the embodiments shown in FIGS. 4–6.

Referring now to FIG. 7, a diagram of one embodiment of an electrical circuit for the invention, is shown. Female portion 58 of electrical jacket 60 is of a conventional type having two terminals 51*a* and 51*b* electrically connected to one terminal 53 on plug 62, and a third terminal 51*c* which will be electrically connected to the other terminal 55 on plug 62. A fourth terminal 51*d* is positioned so as to be in electrical contact with a spring-biased lever arm 57 of terminal 51*c* when plug 62 is removed from female portion 58. The electrical contact between terminal 51*c* and 51*d* is broken at all times that plug 62 is inserted in female portion 58.

When plug 62 is inserted in female portion 58, electrical current will flow from terminal 51*a* to switch 52 for selective passage to terminal 20 of light bulb 12. After lighting bulb 12, current flows from terminal 18 back to terminal 51*c*, through lever arm 57 to terminal 55 of plug 62. Thus, low voltage current from plug 62 will directly light light bulb 12 when switch 52 closes the circuit. Terminal 51*b* of female portion 58 is also electrically connected to terminal 53 of plug 62 and conducts electricity to terminal 54 of battery cartridge 40. The other terminal 46 of battery cartridge 40 is electrically connected through a resistor 59 to conductor 48, as shown in the drawings. Thus, when switch 52 is open, current from plug 62 will recharge the batteries in battery cartridge 40. Resistor 59 is inserted to reduce the current from plug 62 to an acceptable value for recharging the batteries and cartridge 40. Terminal 51*d* is electrically connected between terminal 46 on battery cartridge 40 and resistor 59, such that current from battery cartridge 40 will pass directly to light bulb 12 without having to pass through resistor 59, when plug 62 is removed from the electrical jack 60. This particular arrangement allows continuous use of heating element 10 when the tool is connected directly to a power pack 64 and household current. Simultaneously, batteries in battery cartridge 40 will be recharged during the times that switch 52 is open. This connecting the tool from the power pack 64 allows use of the tool via battery cartridge 40.

Light bulb 12 may be any conventional low voltage bulb (preferably of 12 volts or less) commonly found in flashlights, interior automobile lighting and the like. A low voltage bulb has many advantages over the conventional use of an electrical resistance coil wrapped around a solid core. First, the bulb is a much more efficient producer of heat, since light is produced in an incandescent bulb by heating a filament to a high temperature. The applicants have found that the more recent use of halogen bulbs produces a much hotter heating element at a low voltage, but requires a slightly higher current.

Second, because a light bulb is used as the heating element, it is unnecessary to add further light bulbs in order to illuminate the work area. Thus, there is no need for additional current to run additional electrical devices.

Because a light bulb is used as the entire heating element, the substantial weight of conventional resistance coils and cores is eliminated from the tool. Thus, the heating of the tool occurs extremely rapidly and will cool rapidly after use. Conventional tools require a long period of time to heat up and cool off.

Yet another advantage of using the light bulb heating element of this invention, is in the fact that conventional low voltage light bulbs may be utilized as a heating element, and therefore are easily and economically replaceable. It is a simple matter to remove the light bulb and metal jacket from a conventional socket holder and replace it with an additional light bulb and jacket. In fact, conventional light bulb sockets may be utilized with this invention.

Another important benefit realized in the low voltage heating element of this invention, is the virtual elimination of the risk of high voltage electrical shock by a user. The potential for electrical shock is greater with tools which are capable of use in humid or wet areas —such as in soldering plumbing connections, or when the tool is used at anytime out of doors. An especially hazardous situation is present in the use of curling irons, which are routinely used in bathroom areas of a residence near sinks, tubs and other water sources. Use of a 12 volt, low current heating element virtually eliminates the possibility of electrical shock. Although the heating element is capable of being shorted out by its contact with water, the heating element is easily and quickly replaceable in any event.

Another safety feature of the present invention is the fact that a low voltage small current flows through any wires that may be connected between the tool and a power source. Thus, the possibility of the wires overheating to cause a fire hazard is eliminated. Also, in the event that such wires are broken, cracked or are otherwise damaged, any potential electrical shock or fire hazard are also eliminated.

The inventors have found that use of a halogen bulb which is wrapped in a thin copper jacket, the jacket being darkened to a black mat finish on the interior face adjacent the bulb, produces a rapid and extremely high-temperature heat. It was further found that even a 6-volt halogen bulb was capable of melting solder with the use of a copper metal jacket, but without requiring the darkened face on the jacket.

The most efficient use of a light bulb as a heating element was found in the use of an incandescent bulb, which requires less current than the halogen bulbs. An incandescent bulb can be utilized in a soldering tool if the bulb is tightly wrapped with the copper metal jacket darkened on the inside surface, as described above. Use of the incandescent bulb required a lesser current than halogen bulbs, allows for prolonged use of a single battery charge, yet allows the desired operating temperature to melt solder to be easily and quickly reached.

Another safety factor inherent in the design of the applicant's invention is the enclosure of the light bulb within a metal covering, which helps prevent breakage of the bulb. The use of a metal covering also gives protection to the user from direct contact with a broken or defective bulb.

Since the heating element operates at a low current and low voltage, it is has been found that once the rechargeable batteries in battery cartridge 40 have been reduced in power, or depleted, it is still possible to operate the tool merely by plugging in the power pack 64 through the electrical jack 60. Most conventional "cordless" tools are unable to be operated by this low voltage current being supplied to recharge the batteries. Thus, applicants tools may be utilized continuously, using the power pack 64 directly when the batteries have run down.

In the soldering iron 34, the applicants utilize a 6 volt D.C. battery pack of rechargeable batteries, and found that the tool could be operated continuously at its highest temperature with a halogen 6-volt, 20 watt bulb for over an hour. It can be seen that since soldering irons are not typically "on" continuously during soldering operations, the actual period of time in which the tool may be used solely on the battery power would be much longer. To provide a higher intensity heat in a shorter time, the applicants prefer to use 10 1.2 volt rechargeable cells to provide 12 volt D.C. current to a 55 watt halogen bulb.

Referring now to FIG. 4, a cordless hot glue gun is designated generally at 66, and utilizes the light bulb heating element 10 of this invention to heat and melt the glue stick 68. Glue gun 66 includes a housing 70 which has a barrel 72 through which the glue stick 68 is fed into a hollow metal glue-melting tubular chamber 74 having a funnel-like tip 76. The conventional coiled-wire-and-core heating element (not shown) has been removed from the housing 70 and replaced with a small, low voltage light bulb heating element 10.

Heating element 10 is placed in contact with tubular chamber 74 so as to transfer heat conductively thereto. An aperture 78 is drilled in the end of housing 72 adjacent tubular chamber 74 and allows light from light bulb 12 to project outwardly to the work area when the heating element 10 is turned on. Heating element 10 is electrically connected to a rechargeable battery pack 80 through a normally open switch 82 in a manner similar to that disclosed for soldering iron 34 in FIGS. 6 and 7. An electrical jack 84 is connected to rechargeable battery pack 80, also in a manner similar to that disclosed in FIGS. 6 and 7 for the soldering iron. Thus, the glue gun 66 may be operated from the rechargeable batteries by closing switch 82 in a "cordless" manner. The gun 66 may also be operated utilizing a power pack 86 during times when the batteries are being recharged.

Housing 70 has been provided with a small clear window 88 located proximal to light bulb 12 so that it is possible to visually inspect whether the heating element is on at any given time. When the heating element is on, light will be seen in clear window 88. It is noted that an additional light bulb is not required in order to accomplish this additional feature.

Figure 5:
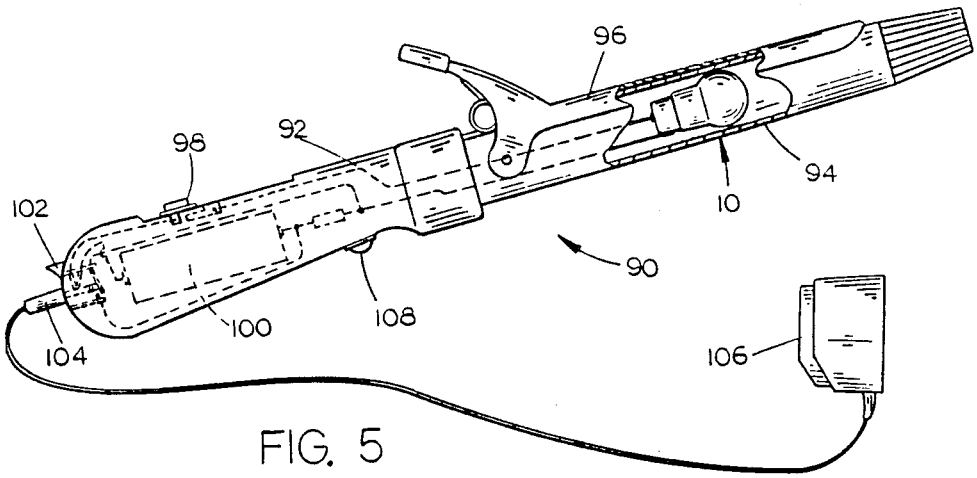
FIG. 5 is a sectional view through a cordless curling iron utilizing the present invention.

Referring now to FIG. 5, a cordless curling iron is designated generally at 90 and includes a generally cylindrical housing 92, a hollow metal tube 94 extending from one end of housing 92, and a pivotable clip 96 which acts to hold curled hair around tube 94. As with the previously discussed tools, the conventional heating unit (not shown) was removed from the curling iron 90 and has been replaced by an electric light bulb heat element 10 of this invention. Heat element 10 is electrically connected through a switch 98 to a rechargeable battery pack 100. An electrical jack 102 is affixed in one end of housing 92 and will receive the male plug 104 of a power pack 106, in a manner similar to the soldering iron 34 and glue gun 66.

The temperature which may be produced by the heating element of the applicants' invention may be varied in a number of ways. A reduction in voltage or current value of the bulb will reduce the heat produced by the bulb. An incandescent bulb will not produce as much heat as a halogen bulb. The density of the metal jacket surrounding the bulb affects the temperature —greater density materials heating up more slowly and to a lower temperature. Thin, low-density materials will heat up rapidly and produce a higher temperature. The distance from the bulb to the metal jacket affects the temperature —an increase in the distance between the bulb and the jacket decreasing the heat which is transferred to the metal jacket. The degree to which the interior surface of the metal jacket is darkened will also affect the operating temperature —the darker the coating applied, the greater the temperature produced. The size of the bulb filament and the distance of the filament from the glass of the bulb also affects the temperature —the closer the filament is to the glass covering, the higher the heat produced. Similarly, bulbs having a smaller amount of glass surrounding the filament will heat up more quickly and to a higher temperature. Since glass acts as a heat sink, light bulbs with thicker glass will produce less heat.

Because the temperature of the tube portion 94 of a curling iron is critical, the variables discussed above will affect the final product manufactured. Temperature is critical since a temperature which is too low will not curl the hair effectively, while a temperature which is too high can readily burn the hair.

Conventional curling irons also have the disadvantage of requiring long amounts of time to heat the elemental tube. The cordless curling iron 90 of this invention overcomes the problems in the prior art and maintains a safe specific temperature with a rapid heat up time. The curling iron 90 of this invention utilizes a 6-volt halogen bulb inserted within a stainless steel tube 94, the inside of which is darkened with carbon substance (as described hereinabove). The stainless steel tube has a thickness which is thinner than conventional curling irons, thereby decreasing heat up time and decreasing the necessary amount of current to heat up the tube. Darkening of the interior of the tube also allows a low voltage, low wattage bulb to produce the high temperature required. Five of the conventional cylindrical sub "C"-type 1.2 volt rechargeable batteries conveniently fit within the handle of the curling iron and allow continuous operation of the iron for approximately one hour.

Figure 8:
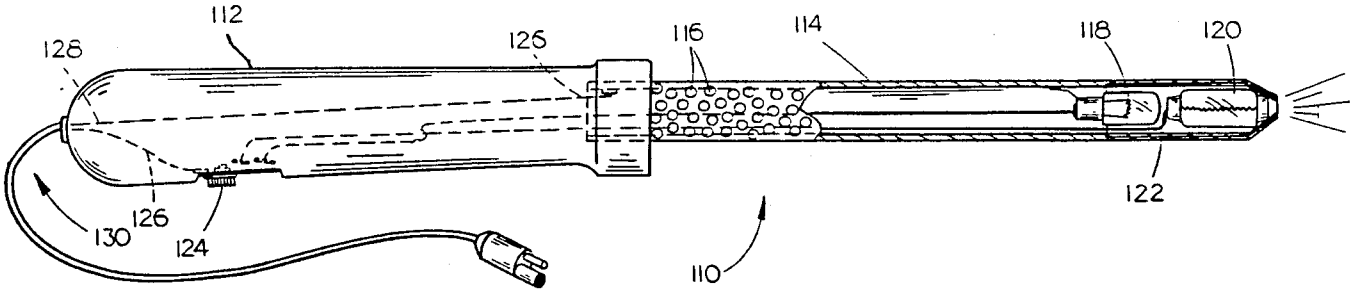
FIG. 8 is a partial sectional view through a second embodiment of a soldering iron.

Referring now to FIG. 8, a second embodiment of a soldering iron is designated generally at 110, and is of the "wand" type. This embodiment of the invention removes the conventional solid core type heat element from the handle 112 and utilizes only a conventional low voltage external power source. Soldering iron 110 includes a hollow handle portion 112 and a metal, electrically conductive hollow tube portion 114, having apertures 116 in the handle connected end to serve as cooling ports. A 12 volt halogen bulb 118 is mounted in the end of tube 114, as shown in the drawings. A 12 volt incandescent bulb 120 is mounted to the end of halogen bulb 118 as shown in the drawings. A thin metal jacket 122 is wrapped around both bulbs and darkened as previously described hereinabove. The positive terminal of each bulb 118 and 120 is electrically connected to one terminal of a two position switch 124. The negative terminal of bulbs 118 and 120 are connected to tube 114 to a common ground 126. The other terminal of two position switch 124 is connected to one conductor 126 of a wired pair 130, the other conductor 128 being connected to the common ground 126. Wire pair 130 are electrically connected to a source of low voltage, low current power. This may be a conventional battery pack, a cigarette lighter, or a power pack which reduces power from conventional household current.

The benefit of connecting the batteries externally to a tool is twofold. First, the overall weight of the soldering iron is greatly reduced by the removal of all batteries from the soldering iron housing. Since the heating element of this invention requires only very small gauge wires for the low voltage current necessary to operate the light bulb, wires connecting the tool to the battery pack may also be quite small and light weight. This light weight wand version of the soldering iron may thereby be used for long periods of time with little fatigue to the hand, and thus may be more desirable for elderly, handicapped persons or any situation where a light weight soldering iron is preferred.

A second benefit of utilizing an external battery pack is the availability of a greater capacity battery. Connection of a battery supply larger than the area allowed in the internal housing of the tool allows prolonged use of the soldering iron beyond that possible with batteries installed on the housing. The inventors have found that connection of a wand having a 12 volt 55 watt halogen bulb to a 12 volt D.C. 2.9 amp battery provided approximately one hour of continuous use.

As can be seen in the drawings, the two position switch enables the heating element temperature to be easily altered. In order to quickly heat the soldering iron, the switch may be set on "high" to provide power to the high intensity halogen bulb 118. This draws more power and will produce a greater amount of heat in a shorter amount of time. Once the appropriate temperature is reached, the switch may then be moved to the "low" position, wherein the lower intensity 12 volt incandescent bulb is activated and the halogen bulb is deactivated. This allows prolonged life of the battery and utilizes the less expensive incandescent bulb to a much greater degree, thereby prolonging the life of the more expensive halogen bulb. It was found that the 12 volt 55 watt halogen bulb would produce heat in excess of 400° F when connected to 12 volts of D.C. current. The incandescent bulb produced temperatures in excess of 315° F with a 12 volt, 1.2 amp input and drawing 14 to 16 watts. This temperature very effectively and efficiently melts conventional 60/40 solder.

Figure 9:
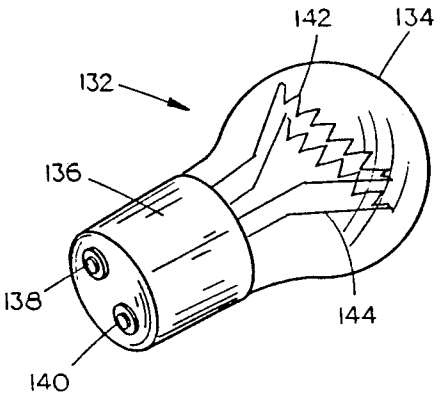
FIG. 9 an enlarged perspective view of a two-filament light bulb.

Referring now to FIG. 9, a two-filament bulb is designated generally at 132 and includes a glass globe 134, a metal base terminal 136, a pair of positive terminals 138 and 140 and a pair of filaments 142 and 144. Bulb 132 utilizes negative terminal 136 as a common ground for filaments 142 and 144 with terminals 138 and 140 serving as the positive terminals for filaments 142 and 144 respectively.

The double filament bulb 132 may be substituted in any of these tools to provide two different intensity heat elements. One example of a two-filament bulb is the tail light/brake light bulbs used in many automobiles. One filament 142 is a high intensity filament and draws more current than the lower intensity filament 144. Each positive terminal 138 and 140 would be electrically connected to different positions on a two position switch such that either filament 142 or 144 may be selected.

Another method of providing different intensity heat from a single light bulb, is to vary the voltage and current to the bulb. Since a resistor defeats the function of reducing the current and voltage to a bulb, such a resistor should be avoided for this purpose. The battery pack common to each of the above described tools could be split to form two 6 volt battery packs connected in series. One position on a two-position switch would be connected to one of the "split" 6 volt battery packs, whereas the other position of the two-position switch would be connected to the two split packs in series. Thus, 6 volts would be provided on one position of the switch, while 12 volts would be provided on the second position of the switch.

The applicant has found that a "high/low" switch may be effectively utilized in the present invention by connecting the "low" position of the switch to a 6-volt incandescent bulb, and the "high" position on the switch to a 6 volt halogen bulb, similar to the soldering iron of FIG. 7. Thus, use of the "high" setting would rapidly heat the curling iron to the desired temperature, while use of the "low" setting, would draw less current and maintain the desired temperature for a longer period of time than possible with the halogen bulb alone. The use of a two-filament bulb, as described hereinabove, would also achieve this desired effect. In a manner similar to the hot glue gun, a window 108 may be inserted in housing 92 such that light from the heating element may be viewed during operation of the device.

It can therefore be seen that the present invention fulfills at least all of the above stated objectives.

I claim:

1. A low voltage heating element for a portable tool, comprising:

a low voltage, low direct current light bulb which is mounted on said tool;

means for powering said light bulb at a voltage of substantially twelve volts or less to said light bulb; and a thin metal heat conducting jacket surrounding at least a portion of said bulb, said bulb being adapted to produce temperatures of 120° F or greater.

2. The heating element of claim 1, wherein said bulb is a halogen bulb.

3. The heating element of claim 1, wherein said metal layer has a coat of dark colored material on the bulb-facing surface.

4. The heating element of claim 3, wherein said dark colored material is a combustion-produced carbon product.

5. The heating element of claim 1, wherein said metal layer has at least one aperture therethrough to allow light produced by said bulb to escape therethrough.

6. The heating element of claim 1, wherein the metal layer completely surrounds said bulb.

7. The heating element of claim 1, wherein said means for powering are battery means.

8. The heating element of claim 7, wherein said battery means are rechargeable battery means.

9. A portable soldering iron, comprising:

a housing;

a metal support member for supporting a heating element, projecting from said housing;

a low voltage, low direct current heating element removably mounted on a free end of said support member;

said heating element including:

a low voltage, low current light bulb mounted in said housing; and a thin metal heat conducting jacket surrounding at at least a portion of said bulb;

said heating element being adapted to produce temperatures of 120° F or greater; and means for powering said light bulb electrically at a voltage of substantially twelve volts or less connected to said heating element.

10. The portable soldering iron of claim 9, wherein said bulb is a halogen bulb.

11. The portable soldering iron of claim 9, wherein said metal layer has a coat of dark colored material on a bulb-facing surface.

12. The portable soldering iron of claim 11, wherein said dark colored material is a combustion produced carbon product.

13. The portable soldering iron of claim 9, wherein said metal layer has at least one aperture therethrough to allow light produced by said bulb to escape therethrough.

14. The portable soldering iron of claim 9, wherein the metal layer completely surrounds said bulb.

15. The portable soldering iron of claim 9, wherein said means for powering are battery means.

16. The portable soldering iron of claim 9, further comprising an electrical socket mounted inside said housing adapted to receive an electrical plug connected to a power pack means for providing 12 volts or less of electrical power to said light bulb.

17. The portable soldering iron of claim 9 further comprising electrical switch means interposed in said electrical connection between said means for powering and said light bulb, such that said light bulb may be selectively powered.

18. The portable soldering iron of claim 17, wherein said light bulb is a two-filament bulb, one filament being a high-intensity filament and one filament being a low-intensity filament, and wherein said switch means includes a first position electrically connected to said high-intensity filament and a second position electrically connected to said low-intensity filament, whereby power may be selectively connected to either filament.

19. The portable soldering iron of claim 17, further comprising:

a second low voltage, low current light bulb drawing a higher current than said first light bulb and mounted adjacent thereto;

said switch means including a first position electrically connected to said first bulb and a second position electrically connected to said second bulb, whereby power may be selectively connected to either light bulb.

20. A portable hot-melt glue gun, comprising:

a hollow housing having a barrel portion and a stock portion;

a hollow metal tube mounted in said barrel portion of said housing and having a dispensing end projecting from said housing, said tube adapted to melt a glue stick therein for dispensing melted glue through said dispensing end;

a low voltage, low direct current heating element removably mounted in said housing in abutting contact with a portion of said hollow metal tube;

said heating element including:

a low voltage, low direct current light bulb;

means for powering said light bulb electrically at a voltage of substantially twelve volts or less and which is connected to said light bulb; and a thin metal heat conducting jacket surrounding at least a portion of said bulb, said bulb being adapted to produce temperatures of 120° F or greater.

21. The portable hot-melt glue gun of claim 20, wherein said metal layer has a coat of dark colored material on a bulb-facing surface of said metal layers.

22. A portable curling iron, comprising:

a hollow housing;

a hollow, heat-conducting metal tube mounted on said housing and projecting therefrom;

a low voltage, low direct current heating element removably mounted within said hollow metal tube for heating the same;

said heating element including:

a low voltage, low direct current light bulb having a globe portion at an end portion thereof and a base portion;

means for powering said light bulb electrically at a voltage of substantially twelve volts or less connected to said light bulb; and a thin metal heat conducting jacket wrapped around and contacting at least a portion of said globe portion of said bulb, said bulb being adapted to produce heat in excess of 150° F.

23. The portable curling iron of claim 22, wherein said metal layer has a coat of dark colored material on a bulb-facing surface of said metal layer.

* * * * *